US007029201B1

(12) United States Patent
McCormick et al.

(10) Patent No.: US 7,029,201 B1
(45) Date of Patent: Apr. 18, 2006

(54) UTILITY LINE BEDDING FOR STORM WATER MANAGEMENT AND STORM WATER MANAGEMENT SYSTEM AND METHOD

(75) Inventors: Thomas M. McCormick, Delray Beach, FL (US); Daniel E. Medina, Takoma Park, MD (US)

(73) Assignee: CH2M Hill, Inc., Englewood, CO (US)

( * ) Notice: Subject to any disclaimer, the term of this patent is extended or adjusted under 35 U.S.C. 154(b) by 0 days.

(21) Appl. No.: 10/651,320

(22) Filed: Aug. 28, 2003

(51) Int. Cl.
*E02B 11/00* (2006.01)

(52) U.S. Cl. ..... 405/50; 405/36

(58) Field of Classification Search ..... 405/36, 405/50, 43, 49, 48, 45, 39, 40, 41
See application file for complete search history.

(56) References Cited

U.S. PATENT DOCUMENTS

| | | | | | |
|---|---|---|---|---|---|
| 2,007,969 | A | | 7/1935 | Grodsky | |
| 3,188,694 | A | * | 6/1965 | Hammar | 52/143 |
| 3,374,593 | A | * | 3/1968 | Rensch | 52/283 |
| 3,568,455 | A | | 3/1971 | McLaughlin | |
| 3,623,296 | A | * | 11/1971 | Santoro | 52/79.12 |
| 3,675,432 | A | | 7/1972 | Keene | |
| 3,816,931 | A | * | 6/1974 | LaMar | 33/563 |
| 3,952,529 | A | | 4/1976 | Lefever | |
| 3,973,407 | A | | 8/1976 | Vecchio | |
| 4,057,500 | A | | 11/1977 | Wager | |
| 4,197,036 | A | | 4/1980 | Masquelier | |
| 4,199,272 | A | | 4/1980 | Lacey | |
| 4,337,006 | A | | 6/1982 | Lacey | |
| 4,620,817 | A | | 11/1986 | Cushing | |
| 4,880,333 | A | | 11/1989 | Glasser | |
| 4,917,536 | A | | 4/1990 | Glasser | |
| 4,925,342 | A | | 5/1990 | Hendy | |
| 4,934,865 | A | | 6/1990 | Varkonyi | |
| 5,120,164 | A | * | 6/1992 | Iacocca et al. | 405/284 |
| 5,316,410 | A | * | 5/1994 | Blume | 405/45 |
| 5,342,144 | A | | 8/1994 | McCarthy | |
| 5,492,434 | A | | 2/1996 | Adams | |
| 5,495,696 | A | * | 3/1996 | Repka | 52/169.5 |
| 5,688,073 | A | | 11/1997 | Brodeur | |
| 5,735,304 | A | | 4/1998 | Chumley | |
| 5,752,784 | A | | 5/1998 | Motz | |
| 5,765,967 | A | * | 6/1998 | Klaymar | 405/179 |
| 5,810,510 | A | | 9/1998 | Urriola | |

(Continued)

*Primary Examiner*—Sunil Singh
(74) *Attorney, Agent, or Firm*—Swanson & Bratschun LLC

(57) ABSTRACT

A water retaining and dissipating bedding for a utility line consists of an elongate trench formed in the earth. A filter fabric wrap is provided lining a lengthwise segment of the trench, with a lengthwise segment having a select length. A first select depth of a porous particulate material resting on a trench bottom underlies a non-perforated utility line being installed and supports the non-perforated utility line in the lengthwise segment. A second select depth of porous particulate material overlies the non-perforated utility line in the lengthwise segment. The length of the lengthwise segment, the first select depth and the second select depth are selected to store a select volume of water. A water supply may be provided in liquid communication with the porous particulate material. The water supply may be a bioretention facility for capturing storm water run-off. A method of building a water retaining and dissipating bedding for a non-perforated utility line includes determining a volume of water to be dissipated and selecting the length of the lengthwise segment, the first select depth and the second select depth are selected to store the determined volume of water.

10 Claims, 4 Drawing Sheets

U.S. PATENT DOCUMENTS 5,836,716 A * 11/1998 Johnson et al. ..... 405/43
5,848,856 A 12/1998 Bohnhoff
5,997,735 A * 12/1999 Gorton ..... 210/151
6,048,131 A 4/2000 Laak
6,095,718 A 8/2000 Bohnhoff
6,227,763 B1 5/2001 Kuhns
6,270,661 B1 * 8/2001 Jowett ..... 210/151
6,277,274 B1 8/2001 Coffman
6,383,372 B1 5/2002 Houck
6,428,239 B1 8/2002 Davis
6,505,996 B1 1/2003 Ianniello
2002/0172557 A1 11/2002 Chen
2003/0059258 A1 3/2003 Lee
2003/0082004 A1 5/2003 Wilkerson
2003/0082005 A1 5/2003 Scott
2003/0094309 A1 5/2003 Dimitroff
2003/0118402 A1 6/2003 Sakamoto
2003/0118405 A1 6/2003 Sakamoto

* cited by examiner

UTILITY LINE BEDDING FOR STORM WATER MANAGEMENT AND STORM WATER MANAGEMENT SYSTEM AND METHOD

TECHNICAL FIELD

The present invention is directed toward water management, and more particularly toward a utility line bedding structure for storing and dissipating storm water run-off.

BACKGROUND ART

Disposal of surface run-off from storm events and the like is a significant problem, particularly in urban areas with a high percentage of paved surfaces. Many older cities in the eastern part of the United States utilize combined storm and sanitary sewers with the combined effluent being treated at wastewater treatment plants. In the event of a large storm exceeding the design capacity of the combined system, direct discharge of raw sewage into receiving waterways may result. Other parts of the country utilize separate storm and sanitary sewers. Localized flooding problems may arise, however, either through under design of the storm water systems or through changes in the run-off patterns resulting from development. Typically such a problem would be addressed by adding additional storm sewers or enlarging existing storm sewers. However, this is a costly process which causes great inconvenience to local residents. In addition, in times of local, state and federal budget deficits, expansion of existing storm water sewers can be difficult to finance.

In areas of rapid growth it is not unusual for a municipality or a developer to need to expand water, sanitary sewers, gas lines, cable access, telephone lines, electrical lines or the like (collectively, "utility lines") to meet the needs of a growing population. Often these utility lines are financed through specific assessments and management of storm water through expansion of existing storm water sewers is beyond the scope of the construction projects. Construction of these utility lines requires excavation and trenching which, if funding were available, could accommodate expanded storm sewers in a single trenching operation without requiring separate trenching and the attendant destruction and then repair of roadways and sidewalks affected by the trenching.

A conventional prior art utility line trench 10 is illustrated in FIG. 1. The trench 12 is excavated to a depth slightly below the depth a utility line 14 will be placed. A porous particulate material, for example, gravel, forms a bed 16 several inches above the trench bottom 18 and supports the utility line 14. A compactable backfill forms a cover 20 over approximately two-thirds of the utility line 14 outer diameter. The remainder of the trench is filled with native materials 22 from the extraction and the trench is capped with a suitable top soil 24 to promote plant growth. As illustrated in FIG. 1, the conventional utility line trench 10 lies above the mean water table elevation 26, although in instances where the water table elevation is close to the surface, the trench may lie within the water table as well.

One known solution for storage and dissipation of storm water run-off is the use of earth drains. An earth drain is essentially a well connected to an underlying water table which receives surface run-off and rapidly percolates it into the water table. Also known are the use of French drains which consist of a trench filled with a granular porous material such as gravel which can receive and temporarily store surface run-off while the surface run-off percolates to the underlying water table. While such structures provide a means of disposing of surface run-off without having to tap into or expand existing storm water run-off systems, such systems still require trenching and the attendant inconvenience and costs of digging up intercepting roads and sidewalks.

In addition to earth drains and French drains, a number of surface water retention and dissipation structures are known in the art. One example is shown in Glasser, U.S. Pat. No. 4,917,536. Glasser teaches a fluid reservoir consisting of a stack of plastic core sheets bundled together to form a module. While providing a storage structure apart from a storm sewer system, this structure requires additional excavation and is relatively high cost and thus does not provide a solution to the problem discussed above.

Another underground draining system is taught in Urriola, U.S. Pat. No. 5,810,510. The system of Urriola also consists of a storage tank and the storage tank of Urriola is made of perforated wall modules wrapped in a water permeable geotextile. The storage tanks of Urriola provide for temporary storage of water and enable the water to percolate to the surrounding strata. However, like Glasser, Urriola requires excavation to build a large underground tank and requires the use of the costly perforated wall modules and thus does not provide a cost effective solution to the problem discussed above.

Cushing, U.S. Pat. No. 4,620,817, illustrates an example of a French drain structure. Cushing shows a perforated pipe 64 running through a sand and gravel bedding. As precipitation is collected and directed to the pipe 64, water percolates through the perforation 66 and into the sand and gravel bedding and eventually into the underlying water table.

The prior art has failed to provide a utility line bedding or installation method for a utility line bedding that performs the function of supporting the utility line while simultaneously providing water retention and dissipation in a cost effective manner.

The present invention is directed toward overcoming one or more of the problems discussed above.

SUMMARY OF THE INVENTION

A first aspect of the present invention is a bedding for a utility line. The bedding consists of an elongate trench formed in the earth. A filter fabric wrap is provided lining a lengthwise segment of the trench, with the lengthwise segment having a select length. A first select depth of a porous particulate material resting on a trench bottom underlies a non-perforated utility line being installed and supports the non-perforated utility line in the lengthwise segment. A second select depth of porous particulate material overlies the non-perforated utility line in the lengthwise segment. The length of the lengthwise segment, the first select depth and the second select depth are selected to store a select volume of water.

Preferably, the first select depth is sufficient to provide liquid communication between a bottom of the lengthwise segment of the trench and a water table underlying the trench. Alternatively, at least one drainage well can be provided in liquid communication between a water table underlying the trench and the bottom of the lengthwise segment of the trench.

A conduit may be included providing liquid communication between a source of water and the lengthwise segment of the trench. A perforated pipe may be provided overlying the non-perforated utility line in the lengthwise segment, with the perforated pipe being in fluid communication with the conduit. The source of water may be a bioretention facility consisting of an engineered planting medium overlying a water collection structure, with the surface of the engineered planning medium supporting growing plants. The collection structure is in liquid communication with the conduit. The collection structure may consist of a perforated pipe within a porous particulate material bed, the perforated pipe being in liquid communication with the conduit. The porous particulate material of the bedding may be a gravel, preferably a clean graded gravel.

A second aspect of the present invention is a surface water retention and dissipation structure. The surface water retention and dissipation structure includes a catch basin configured to collect surface water run-off and an elongate trench formed in the earth. A filter fabric wrap lines a lengthwise segment of the trench, the lengthwise segment having a select length. A first select depth of porous particulate material rests on a trench bottom underlying a non-perforated utility line of the lengthwise segment. A second select depth of porous particulate a material overlies the non-perforated utility line in the lengthwise segment. The filter fabric wrap surrounds the porous particulate material. A conduit is in liquid communication between the catch basin and the lengthwise segment. The select length of the lengthwise segment, the first select depth and the second select depth are selected to store a select volume of water received from the catch basin. A perforated pipe may be provided overlying the non-perforated utility line in the lengthwise segment and the perforated pipe is in liquid communication with the conduit. The first select depth is preferably sufficient to communicate the bottom of the trench with a water table underlying the trench. Alternatively, a drainage well may be provided in liquid communication between a water table underlying the trench and the bottom of the trench. A bioretention facility may also be provided in liquid communication with the lengthwise segment. The bioretention facility includes an engineered planting medium overlying a water collection structure, with the surface of the engineered planning medium supporting growing plants and the collection structure being in liquid communication with the conduit. The water collection structure of the bioretention facility preferably consists of a perforated pipe within a porous particulate material bed, the perforated pipe being in liquid communication with the conduit.

A third aspect of the present invention is a method of constructing a utility line bedding for water management, the utility line bedding being configured to contain a select volume of water to be dissipated. As a first step of the method a volume of water to be dissipated is determined. Next, a utility line trench is excavated in the earth at a width sized to receive a non-perforated utility line of a given outer diameter therein. As part of the trench formation a lengthwise segment of the trench is excavated to a select segment length and a lengthwise segment depth. The lengthwise segment of the trench is lined with a filter fabric wrap. A base of porous particulate material is provided on the bottom of the trench to a first select depth in the lengthwise segment of the trench. The non-perforated utility line is laid upon the base. A cover of porous particulate material having a second select depth is provided over the non-perforated utility line. The first select depth, the second depth and the select length of the lengthwise segment of the trench are selected to define a sufficient volume of void space in the porous particulate material to hold the select volume of water to be displaced. The method may further include providing liquid communication between the bottom of the lengthwise segment and a water table underlying the lengthwise segment. The liquid communication may be provided by excavating the lengthwise segment to a depth sufficient for the trench bottom to lie below the surface of an underlying water table. A perforated pipe is preferably provided in the cover of the particulate material over the non-perforated utility line in the lengthwise segment with the perforated pipe being in liquid communication with the source of water to be dissipated.

The bedding for utility line, the water retention and dissipation structure and the method of constructing a utility line bedding for water management of the present invention each address the problem of dissipating excess water from flood prone areas adjacent to an installation site of a utility line. By utilizing a modified trench excavated for installation of the utility line, the present invention minimizes the cost of building the water storage and dissipating structure. At most, marginal increases in costs result from the expenses associated with excavating the utility line deeper than might otherwise be required, the porous particulate matter (e.g., gravel) necessary to fill the trench and the filter fabric wrap encasing the porous particulate material. Where a bioremediation facility is desired, additional costs may be involved. Dissipation of water received in the structure can be significantly enhanced by bringing the elongate portion of the trench forming the retention structure into fluid communication with an underlying water table. This can be achieved most cost effectively simply by excavating the trench sufficiently deep so that the trench bottom resides within the water table, preferably more than a foot under the water table level. Where the water table is too deep to be excavated to, a drainage well can be drilled from the bottom of the trench to the underlying water table to bring the water table into liquid communication with the trench bottom. Because of the marginal costs associated with building the storm water dissipation structure of the present invention, relief from annoying flooding can be afforded residents of rapidly developing areas without the huge expenses associated with constructing new or enlarged storm sewers or contending with the environmental concerns related to the direct discharge of stormwater run-off into surface waters. In coastal communities where saltwater intrusion is a concern this approach also has the benefit of reducing loss of rainwater to tide and thus helps combat salt-water intrusion into surficial aquifers. Furthermore, the method and structures of the present invention require only a single tear up of affected roads and sidewalks, significantly decreasing both the expense and the inconvenience to residents while still effectively addressing annoying and potentially dangerous flooding problems. The addition of a bioretention facility, removes pollutants in the stormwater in the runoff that is released to the water table.

DETAILED DESCRIPTION OF THE PREFERRED EMBODIMENT

Figure 1:
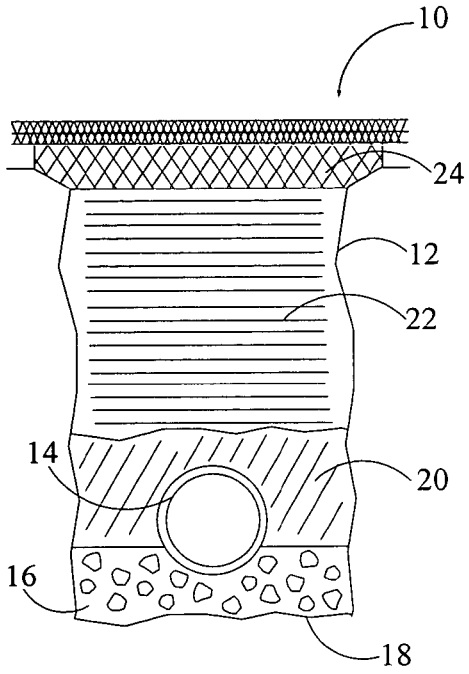
Fig. 1 (Prior Art)
FIG. 1 is a cross-sectional side elevation view of a prior art utility line bedding.
Figure 2:
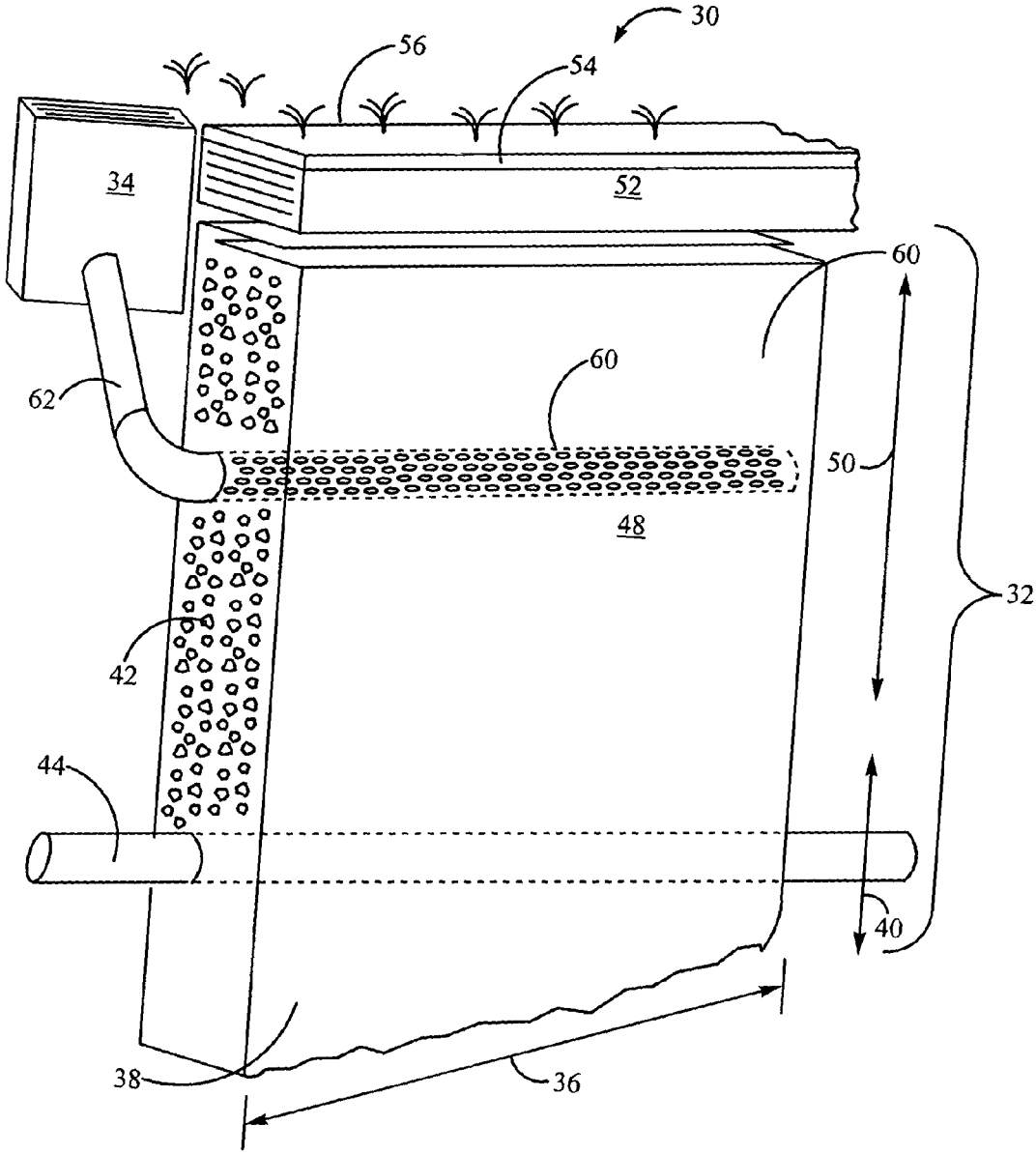
FIG. 2 is a perspective cut away view of a bedding for a utility line in accordance with the present invention.

FIG. 2 illustrates a water retaining and dissipating structure 30 in accordance with the present invention, including a water retaining and dissipating utility line bedding 32 and a conventional catch basin 34. The water retaining and dissipating utility line bedding 32 is shown in cross section in FIG. 3. The water retaining and dissipating utility line bedding 32 is formed from a trench 36 in substantially the same manner that the conventional utility line trench 12 of FIG. 1 is formed. The water retaining and dissipating utility line bedding 32 differs in that it includes a lengthwise segment of trench 36 (see FIG. 2) that is excavated significantly deeper than the trench 12 of a conventional utility line bedding. The lengthwise segment of trench 36 is lined with a filter fabric wrap lining 38 and filled to a first select depth 40 with a porous particulate material 42 forming a base for a utility line 44. The porous particulate material 42 is preferably a clean graded gravel generally sized to between one half to one inch in diameter. The porous particulate material 42 surrounds the utility line 44 and a cover of porous particulate material 48 having a second select depth 50 overlies the utility line 44. The second select depth can vary from zero inches to one or more feet. The porous particulate material may be compacted or not, depending upon design requirements. The filter fabric wrap 38 is securely wrapped around the lateral sides, top and bottom of the porous particulate matter to form a barrier against intrusion of particulates which could fill void spaces between particles of the porous particulate material 42. A fill 52 of native materials from the excavation overlies the wrapped porous particulate material 42 and the trench bed is capped with topsoil 54 for promoting plant growth at the surface 56.

Referring to FIG. 2, the water retention and dissipating utility line bedding 32 preferably further consists of a perforated pipe 60 embedded in the cover 48 overlying the utility line 44. The perforated pipe 60 is connected by a conduit 62 to the catch basin 34 or other water collecting structure.

Figure 3:
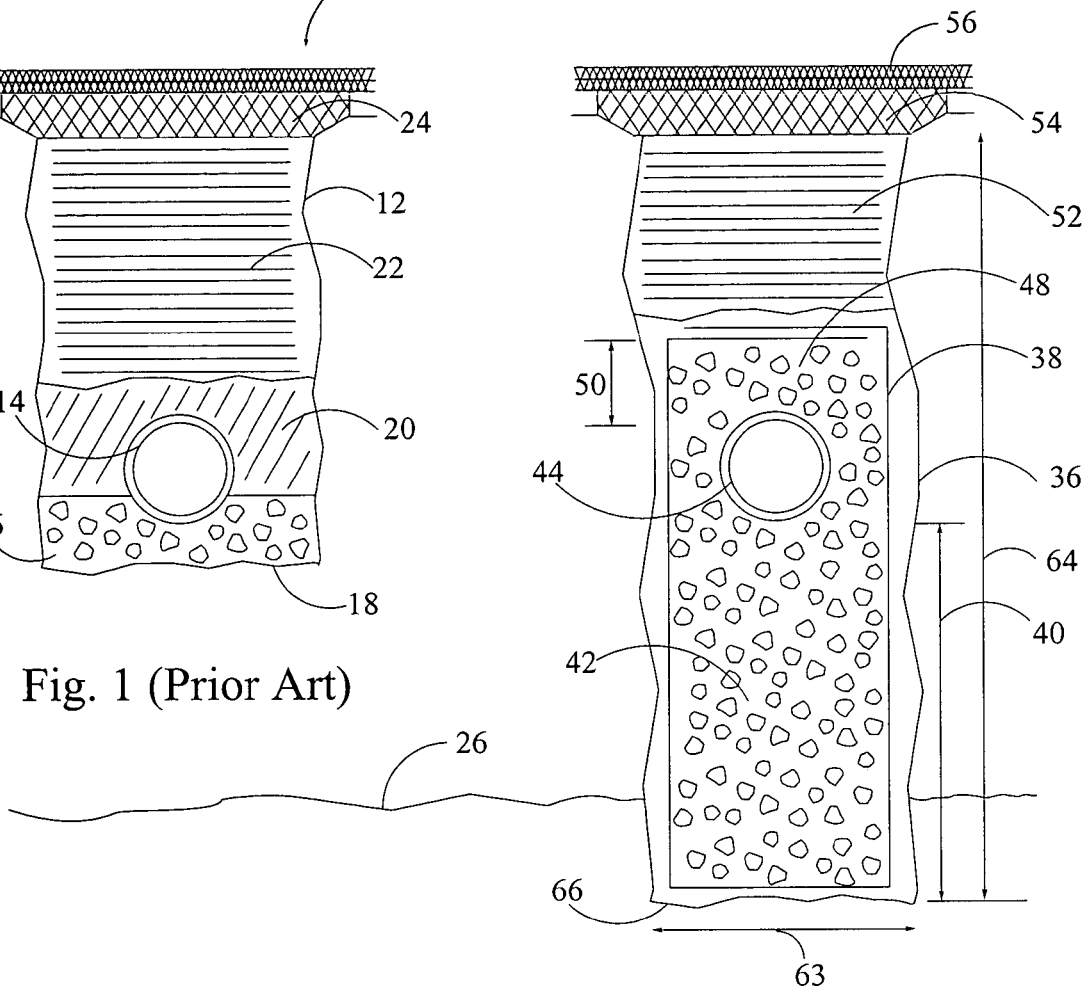
FIG. 3 is a cross-sectional side elevation view of the bedding for a utility line of FIG. 2.

In designing and constructing the water retention and dissipating utility line bed 32, the desired volume of water to be retained within the water retention and dissipating utility line bedding must first be determined. The dimensions of the lengthwise segment of the trench 36 defining the water retention volume are then calculated to accommodate the volume of water. In one embodiment, the water to be dissipated is storm water run-off and the volume of water to be dissipated is calculated based upon the hydrologic characteristics of a basin feeding into the water retention and dissipating utility line bedding and a storm event of a desired magnitude, e.g., the 100-year storm. Referring to FIG. 3, the width 63 of the trench 36 is typically determined as a function of the outer diameter of the utility line 44. For example, where the utility line 44 is a six inch outer diameter pipe, such as a water main, a width 63 of the trench may be 18 inches or more. Of course, the width 63 always exceeds to the outer diameter of the utility line. The overall depth 64 of the trench 36 is preferably selected so that the bottom 66 of the trench 36 lies below the mean water table elevation 26. Preferably, the bottom 66 of the trench is approximately 18 inches or more below the mean water table elevation 26. The first select depth 40 of the base is selected to support the utility line 44 at a desired elevation. The second select depth 50 of porous particulate matter defining the cover 48 if greater than zero inch, is selected so that a sufficient depth of native fill materials 52 and topsoil 54 will overlie the porous particulate matter so as to protect the porous particulate matter and filter fabric wrap 38 from disturbance. Typically, the first select depth 40 is at least 2–3 feet and the second select depth is at least 1 foot. Because often the width 63, the first select depth 40 and the second select depth 50 are more or less determined by characteristics of the trench location, in such circumstances the overall volume of storage is effectively varied by the length 36 of the trench segment. The volume of storage is a function of the void space of the porous particulate material 42, the volume of the utility line 44, the first select depth 40, the second select depth 50 and the length 36 of the trench segment.

The preferred embodiment illustrated in FIG. 3 wherein the trench bottom 66 underlies the mean water table elevation 26 has the advantage of providing a vehicle for transporting surface water run-off directly to the water table to quickly dissipate the surface water run-off. As will be appreciated by those skilled in the art, the rate at which storm water received within the water retention and dissipating utility line bedding 32 can be conveyed to the water table will be a function of the hydraulic conductivity of the water table strata. This rate of uptake will in turn be a criterion in designing the volume of the water retention and dissipating utility line bedding.

In some instances the mean water elevation table will be far enough beneath the surface that the trench cannot be excavated to reach the water table. In this circumstance, generally the volume of water storage must be greater where the water retaining and dissipating structure is used for storm water run-off because the water will percolate out of the porous particulate material and into an underlying water table at a much slower rate. Thus, the lengthwise segment must have a greater length and/or depth than would be required if the trench bottom was below the mean water table elevation.

Figure 4:
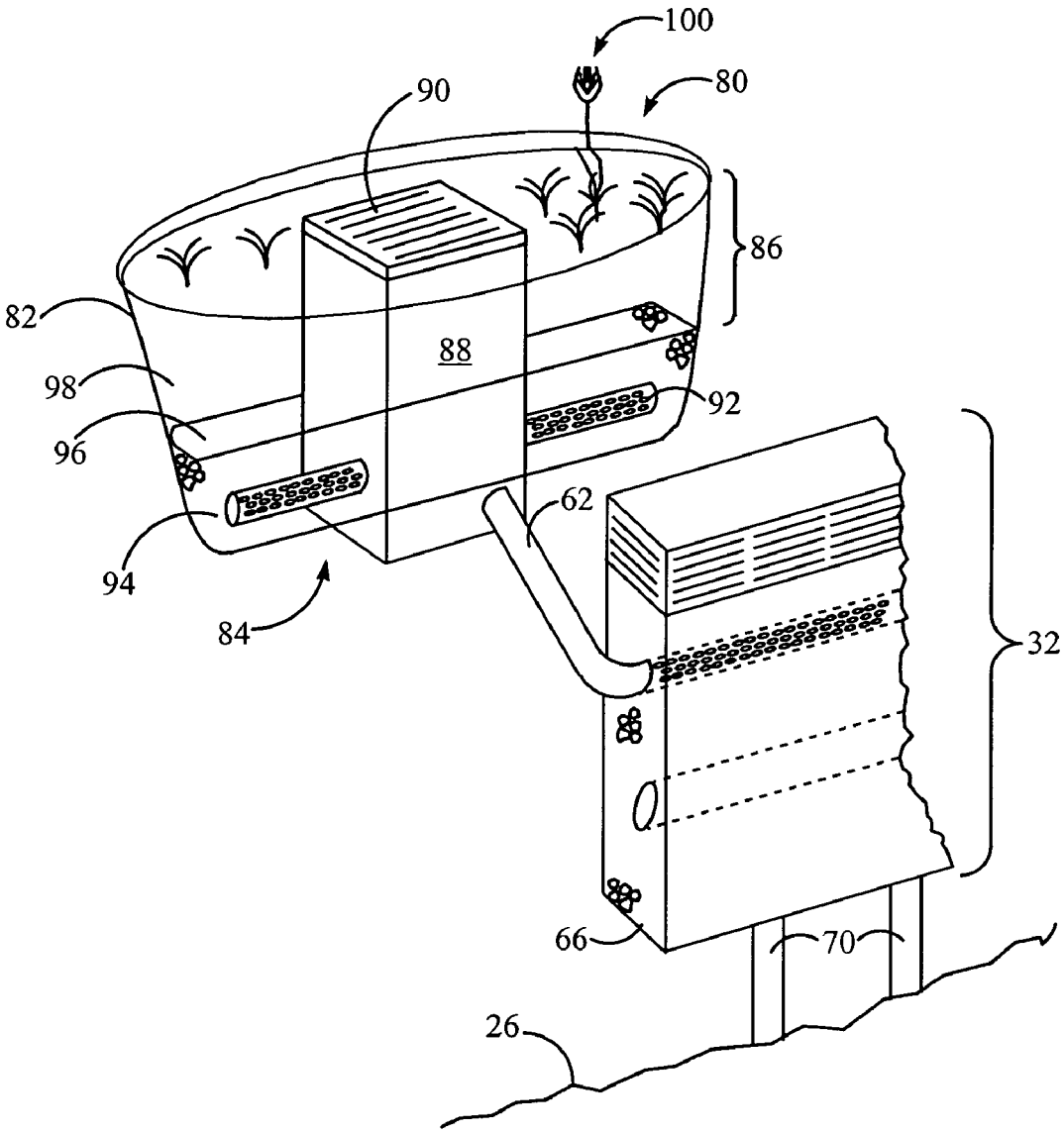
FIG. 4 is a perspective sectional view of a water retention and dissipation structure of the present invention including a bioretention facility.

As an alternative design, illustrated in FIG. 4, where the water table is too deep to be reached by the trench, earth drains 70 may be provided in the bottom 66 of the trench to establish liquid communication between the water table and the lengthwise segment fill. The earth drain 70 will increase the rate of percolation of water from the lengthwise segment to the water table 68.

FIG. 4 illustrates an enhancement to the water retention and dissipation structure 30 illustrated in FIG. 2. The enhancement consists of a bioretention facility 80 which captures surface run-off and conveys it via conduit 62 to the water retention and dissipating utility line bed 32. Such bioretention facilities can often be placed within the right-of-way or roads or utility easements. The bioretention facility 80 is built within an excavation 82 in the earth. The bioretention facility 80 consists of a water collection structure 84 and a water treatment layer 86. The water collection structure 84 consists of a catch basin 88 having an overflow grate 90 on its top and a perforated under drain 92 communicating with the catch basin 88 interior. The conduit 62 is also in liquid communication with the catch basin 88 to deliver water to the water retention and dissipating utility line bedding 32. The collection structure 84 further consists of a porous particulate material bed 94 at the bottom of the excavation 82 within which the perforated under drain 92 resides. The porous particulate material bed 94 is surrounded by a filter fabric wrap 96 to prevent silt and the like from plugging the voids in the porous particulate material 94. The water treatment layer 86 consists of a layer of an engineered planting medium 98 overlying the water porous particulate material bed 94 having a variety of plants 100 on its exposed surface.

In use, during a storm event, storm water run-off flows onto the surface of the engineered planting medium and percolates into the porous particulate material bed 94 and is collected by the perforated under drain 92, conveyed to the catch basin 88 and conveyed by the conduit 62 to the water retention and dissipating utility line bedding 32. The water is filtered by the engineered planting medium and the plants on the surface assist both in obstructing particulates and absorbing contaminates such as nutrients, metals, and hydrocarbons washed onto the surface of the bioretention facility 80 with the surface run-off. In the event of an extreme storm event, storm water may flow directly into the overflow grate 90 and not have the benefit of being filtered through the bioretention facility. However, because the majority of contaminants will be contained in the "first flush" of run-off, which will be filtered through the bioretention facility, water entering the overflow likely will have a much lesser amount of particulate and other contaminants.

Figure 5:
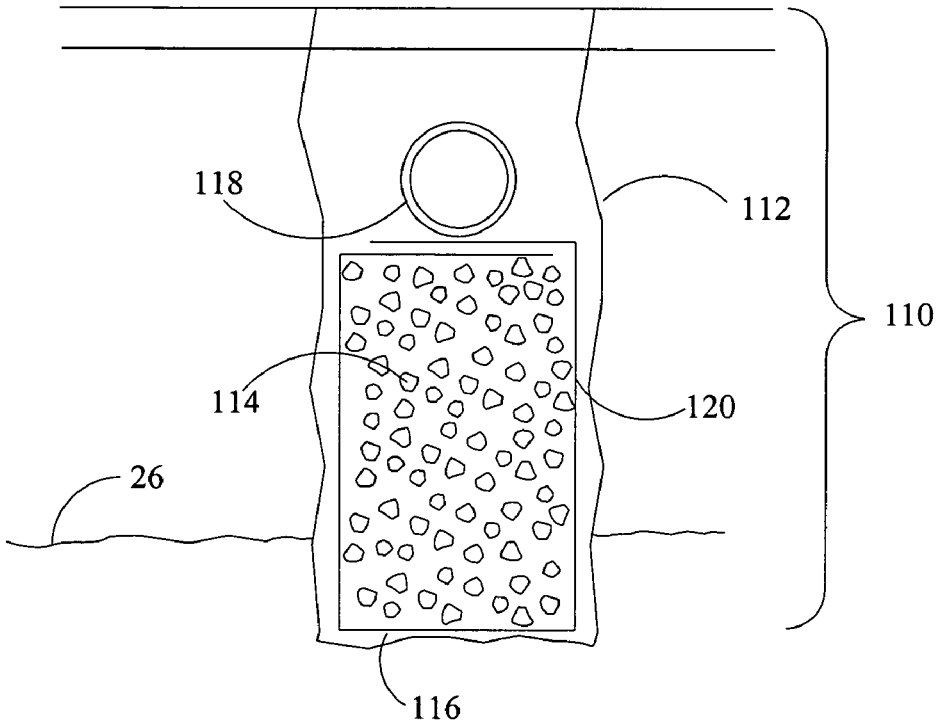
FIG. 5 is a cross-sectional side elevation view of an alternate embodiment of the bedding for a utility line of FIG. 3.

FIG. 5 is a cross-sectional side elevation view of an alternate embodiment of the water retention and dissipating utility line bedding 110. In this embodiment, a trench 112 extends from the earth's surface to below the water table 26. A bed of porous particulate material 114 extends from a bottom 116 of the trench 112 to an elevation necessary to support the utility line 118 as desired. The porous particulate material is surrounded by a filter fabric wrap 120 to prevent soil and debris from filling the voids between the porous particulate material 114. Thus, the primary difference between the embodiment 110 of FIG. 5 and the embodiment of FIGS. 2 and 3 is the absence of the cover 48. Or in other words, the "second select depth" is zero.

The surface water retention and dissipation structure in accordance with the present invention provides an efficient and cost effective vehicle for the storage and dissipation of surface water run-off. These advantages are provided by only minor modifications to conventional utility line bedding trenches and can augment existing storm water run-off facilities or, in some instance, substitute for conventional storm water sewer systems. Utilization of utility trenches eliminates the expense and disruption associated with additional trenching associated with conventional storm water run-off dissipation. Including the bioretention facility as a mechanism for delivering storm water to the surface water retention and dissipating utility line bedding provides removal of particulate and chemical contamination before the surface water is conveyed to the water table. Once constructed, the storm water retention and dissipation system operates substantially expense and maintenance free.

What is claimed is:

1. A bedding for a utility line comprising:

an elongate trench formed in the earth;

a filter fabric wrap lining a lengthwise segment of the trench having a select length;

a first select depth of porous particulate material resting on a trench bottom underlying utility line configured to prevent intrusion of ground water and supporting the utility line in the lengthwise segment;

a second select depth of porous particulate material overlying the utility line in the lengthwise segment;

the select length of the lengthwise segment, the first select depth and the second select depth being selected to store a select volume of water; and a conduit providing liquid communication between a source of water and the lengthwise segment of the trench;

wherein the source of water is a bioretention facility comprising an engineered planting medium overlying a water collection structure, the surface of the engineered planting medium supporting growing plants and the collection structure being in liquid communication with the conduit.

2. The bedding of claim 1 wherein the water collection structure comprises a perforated pipe within a porous particulate material bed, the perforated pipe being in liquid communication with the conduit.

3. The bedding of claim 2 wherein the porous particulate material bed is wrapped in a filter fabric.

4. A surface water retention and dissipation structure comprising:

a catch basin configured to collect surface water run-off;

an elongate trench formed in the earth;

a filter fabric wrap lining a lengthwise segment of the trench having a select length;

a first select depth of porous particulate material resting on a trench bottom underlying a utility line configured to prevent intrusion of ground water in the lengthwise segment;

a second select depth of porous particulate material overlying the utility line in the lengthwise segment; and a conduit in liquid communication between the catch basin and the lengthwise segment;

the select length of the lengthwise segment, the first select depth and the second select depth being selected to store a select volume of water.

5. The surface water retention and dissipation structure of claim 4 further comprising a perforated pipe in the lengthwise segment, the perforated pipe being in liquid communication with the conduit.

6. The surface water retention and dissipation structure of claim 4 wherein the first select depth is sufficient to communicate the bottom of the trench with a water table underlying the trench.

7. The surface water retention and dissipation structure of claim 4 further comprising at least one drainage well in liquid communication between a water table underlying the trench and the bottom of the trench.

8. The surface water retention and dissipation structure of claim 4 further comprising a bioretention facility comprising an engineered planting medium overlying a water collection structure, the surface of the engineered planting medium supporting growing plants and the collection structure being in liquid communication with the conduit.

9. The surface water retention and dissipation structure of claim 8 wherein the water collection structure comprises a perforated pipe within a porous particulate material bed, the perforated pipe being in liquid communication with the conduit.

10. The surface water retention and dissipation structure of claim 4 wherein the second select depth is zero inches.

* * * * *